US010077135B2

(12) United States Patent
Dupont et al.

(10) Patent No.: US 10,077,135 B2
(45) Date of Patent: Sep. 18, 2018

(54) REFILLABLE DEVICE FOR PACKAGING AND DISPENSING A FLUID PRODUCT

(71) Applicant: LOUIS VUITTON MALLETIER, Paris (FR)

(72) Inventors: Celine Dupont, Colombes (FR); Daniel De Rosa, Louviers (FR)

(73) Assignee: LOUIS VUITTON MALLETIER, Paris (FR)

( * ) Notice: Subject to any disclaimer, the term of this patent is extended or adjusted under 35 U.S.C. 154(b) by 241 days.

(21) Appl. No.: 14/776,544

(22) PCT Filed: Mar. 5, 2014

(86) PCT No.: PCT/FR2014/050495
§ 371 (c)(1),
(2) Date: Sep. 14, 2015

(87) PCT Pub. No.: WO2014/140454
PCT Pub. Date: Sep. 18, 2014

(65) Prior Publication Data

US 2016/0031597 A1 Feb. 4, 2016

(30) Foreign Application Priority Data

Mar. 14, 2013 (FR) ..... 13 52304

(51) Int. Cl.
*B67C 3/00* (2006.01)
*B65D 21/08* (2006.01)
(Continued)

(52) U.S. Cl.
CPC ..... *B65D 21/086* (2013.01); *B05B 11/0097* (2013.01); *B05B 11/04* (2013.01); *B05B 11/047* (2013.01); *B05B 11/048* (2013.01)

(58) Field of Classification Search
CPC ... B05B 11/0097; B05B 11/04; B05B 11/047; B05B 11/048; B65D 21/086
(Continued)

(56) References Cited

U.S. PATENT DOCUMENTS 667,096 A * 1/1901 Lippincott ..... F16L 37/40 141/14
1,613,898 A * 1/1927 Metcalf ..... F04B 9/14 137/322

(Continued)

FOREIGN PATENT DOCUMENTS

| | | |
|---|---|---|
| FR | 2802447 | 6/2001 |
| WO | WO 99/34930 | 7/1999 |
| WO | WO 01/81184 | 11/2001 |

OTHER PUBLICATIONS

WO9934930MT—Machine Translation of WO 99/34930 to Carlotti.*

(Continued)

*Primary Examiner* — Nicholas J Weiss
*Assistant Examiner* — Randall Gruby
(74) *Attorney, Agent, or Firm* — Miller, Matthias & Hull LLP

(57) ABSTRACT

A refillable device for packaging/dispensing a fluid product, comprising: a reservoir delimiting a variable interior volume for containing said product; a product distribution nozzle; a product distribution passage connecting the reservoir and the nozzle and provided with a first closure system designed to allow/prevent a flow of product between the reservoir and the nozzle; an opening for filling with product; and a product filling duct connecting the opening and the reservoir and provided with a second closure system designed to allow/prevent a flow of product between the opening and the reservoir, the second closure system being normally kept closed and being designed for opening via cooperation with a product refilling device. The reservoir is positioned in such (Continued)

a way as to accept a force from a user in order to reduce its volume. The nozzle and the opening open onto one and the same face of the refillable device.

15 Claims, 9 Drawing Sheets

(51) Int. Cl.
*B05B 11/00* (2006.01)
*B05B 11/04* (2006.01)

(58) Field of Classification Search
USPC ..... 141/21, 22, 23, 24, 113, 346, 347, 348, 141/349; 251/149.1–149.9
See application file for complete search history.

(56) References Cited

U.S. PATENT DOCUMENTS 2,243,908 A * 6/1941 Kassab ..... A61M 3/00 141/24
2,401,674 A * 6/1946 Vizay ..... B67C 11/04 137/871
2,989,091 A * 6/1961 Lowenthal ..... F23Q 2/52 141/18
3,035,617 A * 5/1962 Breitenstein ..... B65D 83/75 137/614.04
3,171,448 A * 3/1965 Fromm ..... B67D 7/54 137/588
3,575,221 A * 4/1971 Mochizuki ..... F16K 1/303 141/295
3,640,320 A * 2/1972 Elkuch ..... F16K 1/303 137/588
3,687,174 A * 8/1972 Palan ..... B65D 83/20 141/20
4,211,253 A * 7/1980 Ekman ..... F16L 37/23 137/594
4,421,146 A * 12/1983 Bond ..... B65D 77/06 141/349
4,436,125 A * 3/1984 Blenkush ..... F16L 37/0841 137/797
4,763,683 A * 8/1988 Carmack ..... F16L 37/32 137/594
5,261,573 A * 11/1993 Jouillat ..... B05B 11/004 141/20
5,328,059 A * 7/1994 Campbell ..... B67B 7/28 141/346
5,524,680 A * 6/1996 de Laforcade ..... B05B 11/0037 141/113
5,597,021 A * 1/1997 Crossdale ..... B67D 7/0288 137/590
6,354,469 B1 * 3/2002 Pozzi ..... B05B 11/0018 222/189.09
8,360,101 B2 * 1/2013 Kremer ..... F16K 1/306 137/544
8,381,763 B2 * 2/2013 Moretti ..... F17C 13/04 137/505.11
8,602,057 B2 * 12/2013 Abura ..... F16L 37/23 137/614.03
9,499,388 B2 * 11/2016 Lasnier ..... B05B 11/0056
2008/0272323 A1 * 11/2008 Abe ..... B67D 1/0829 251/149.1
2011/0297275 A1 * 12/2011 Farrar ..... B05B 11/0043 141/113
2012/0006828 A1 * 1/2012 Frenal ..... F16K 1/303 220/581
2012/0090730 A1 * 4/2012 Dumont ..... A45D 34/02 141/2
2012/0234432 A1 * 9/2012 Lamboux ..... A45D 34/02 141/2
2013/0019991 A1 * 1/2013 Muller ..... B05B 11/0056 141/18
2014/0137983 A1 * 5/2014 Tu ..... B05B 11/0056 141/113
2015/0047741 A1 * 2/2015 Wong ..... A45D 34/00 141/113

OTHER PUBLICATIONS

International Search Report for related PCT Application No. PCT/FR14/050495; report dated Apr. 8, 2014.
Rähse, Wilfried, "Produktdesign von Cosmeceuticals am Beispiel der Hautcreme," Chemie Ingenieur Technik, 2011, pp. 1651-1662, 83, No. 10, Wiley-VCH Verlag GmbH & Co. KGaA, Weinheim, Germany.
Kirk-Othmer Encyclopedia of Chemical Technology, 2006, pp. 24-30, Fifth Edition, vol. 18, John Wiley & Sons, Inc., Hoboken, New Jersey.

* cited by examiner

REFILLABLE DEVICE FOR PACKAGING AND DISPENSING A FLUID PRODUCT

CROSS-REFERENCE TO RELATED APPLICATIONS

This application is a 35 USC § 371 U.S. national stage filing of International Patent Application No. PCT/FR2014/050495 filed on Mar. 5, 2014, which claims priority under the Paris Convention and 35 USC § 119 to French Patent Application No. 13 52304, filed on Mar. 14, 2013.

FIELD OF THE DISCLOSURE

The present invention relates to a refillable device for packaging and dispensing a fluid product, comprising:

- a reservoir delimiting a variable interior volume for containing said fluid product;
- a fluid product dispensing nozzle;
- a fluid product dispensing passage connecting the reservoir and the nozzle and provided with a first closure system adapted to be selectively opened/closed to allow/prevent a flow of fluid product between the reservoir and the nozzle;
- a fluid product filling opening; and
- a fluid product filling channel connecting the filling opening and the reservoir and provided with a second closure system adapted to be selectively opened/closed to allow/prevent a flow of fluid product between the filling opening and the reservoir, the second closure system being normally kept closed and adapted to open by collaboration with a fluid product refilling device when the refillable device is mounted on said refilling device.

BACKGROUND OF THE DISCLOSURE

A refillable device of this type is known, for example from document WO 2010/094963 A1, in which a pump is provided in the dispensing passage in order to draw fluid from the reservoir to the nozzle. In this refillable device, the nozzle and the filling opening are arranged opposite one another, thereby allowing usage of the refillable device when said device is mounted on the refilling device.

However, such a refillable device is not optimal in terms of simplicity, compactness, and fluidtightness.

SUMMARY OF THE DISCLOSURE

The present invention aims to overcome these disadvantages by providing a refillable device that is simple to use and manufacture while being compact and fluidtight.

To this end, the invention relates to a refillable device of the aforementioned type, characterized in that the reservoir is arranged to be able to receive a force exerted by a user in a manner that reduces its interior volume, in that the nozzle and the filling opening open onto one and the same face of the refillable device, and in that the refillable device is a device without air intake.

With these arrangements, the refillable device is not only simple to use and to manufacture, but it is also compact, therefore easily carried about, and there is limited risk of leakage of the fluid product and of obstruction of the nozzle and filling opening by foreign bodies such as dust.

In various embodiments of the refillable device according to the invention, one or more of the following arrangements may possibly be used:

- the first closure system comprises a valve which is normally kept closed and which is adapted to open when the interior volume of the reservoir decreases;
- the nozzle and filling opening are concentric to each other, which has the advantage of improving the compactness of the refillable device;
- the dispensing passage comprises a downstream section leading to the nozzle, said downstream section being defined by an internal tube which supports the nozzle, and the filling channel comprises an upstream section leading to the filling opening and defined by the internal tube and an external tube coaxial with the internal tube;
- the internal tube is part of the second closure system and is mounted so as to be movable relative to the external tube between a normal usage position where the internal tube obstructs the filling channel, and a filling position where the filling channel is free of the internal tube, the second closure system further comprising a resilient member urging the internal tube into the usage position;
- the refillable device further comprises an actuation member actuated by a user to act on the reservoir;
- the actuation member is mounted so as to be movable relative to the reservoir between a dispensing position where the actuation member presses against the reservoir, and a rest position where the reservoir is not biased by the actuation member;
- the reservoir is resiliently biased toward a position of maximum volume, which has the advantage of limiting the number of parts forming the reservoir and thus reduces the size of the refillable device;
- the refillable device further comprises an air inlet which opens into the dispensing passage upstream of the nozzle, the air inlet being closed off by a filter permeable to air and impermeable to fluids, which has the advantage of reducing the fluid product particle size and therefore of providing good quality dispensing;
- the refillable device further comprises a resilient member biasing the actuation member toward the rest position, the advantage being that the refillable device maintains its appearance when not in use and therefore is more satisfactory for the user in terms of aesthetics; and
- the valve of the first closure system is a ball valve, which offers the advantage of ensuring good quality dispensing of the fluid product by properly sizing the ball valve, in particular by calibrating its spring, so as to ensure a minimum pressure as the fluid product is expelled.

The invention also relates to an assembly for packaging, refilling, and dispensing a fluid product, characterized in that it comprises:

- a refillable device as described above; and
- a fluid product refilling device, comprising:
  - a container intended for containing said fluid product; and
  - a connector mounted on the container and defining a filling duct for fluid product, provided with a third closure system adapted to be selectively opened/closed to allow/prevent a flow of fluid product from the container,
- the refillable device being adapted for mounting on the connector of the refilling device so that the filling channel and the filling duct are in fluid communication with each other, the second and third closure systems being adapted to be open when the refillable device is mounted on the refilling device.

With these arrangements, the assembly is not only simple to use and to manufacture, but it is also compact and there is limited risk of leakage of the fluid product and of obstruction of the nozzle and filling opening by foreign bodies such as dust.

In various embodiments of the assembly according to the invention, one or more of the following arrangements may possibly be used:

- the third closure system comprises an end cap arranged in the filling duct and mounted so as to be movable relative to the filling duct in order to selectively open/close the filling duct;
- the third closure system further comprises a resilient member adapted to bias the end cap into a position where the end cap closes the filling duct;
- the refillable device and the connector are configured to open the second and third closure systems automatically when the refillable device is mounted on the refilling device, which has the advantage of limiting the number of actions the user must perform in order to use the system;
- the refillable device comprises a fourth closure system adapted to be selectively opened/closed to allow/prevent a flow of fluid product through the filling channel; and
- the fourth closure system is normally in a closed position and is adapted to open when the second and third closure systems are open.

BRIEF DESCRIPTION OF THE DRAWINGS

The invention will be better understood by reading the following description of various embodiments of the invention, given solely by way of non-limiting example with reference to the accompanying drawings, in which.

DETAILED DESCRIPTION OF THE DISCLOSURE

In the different figures, the same references designate identical or similar elements.

Figure 1:
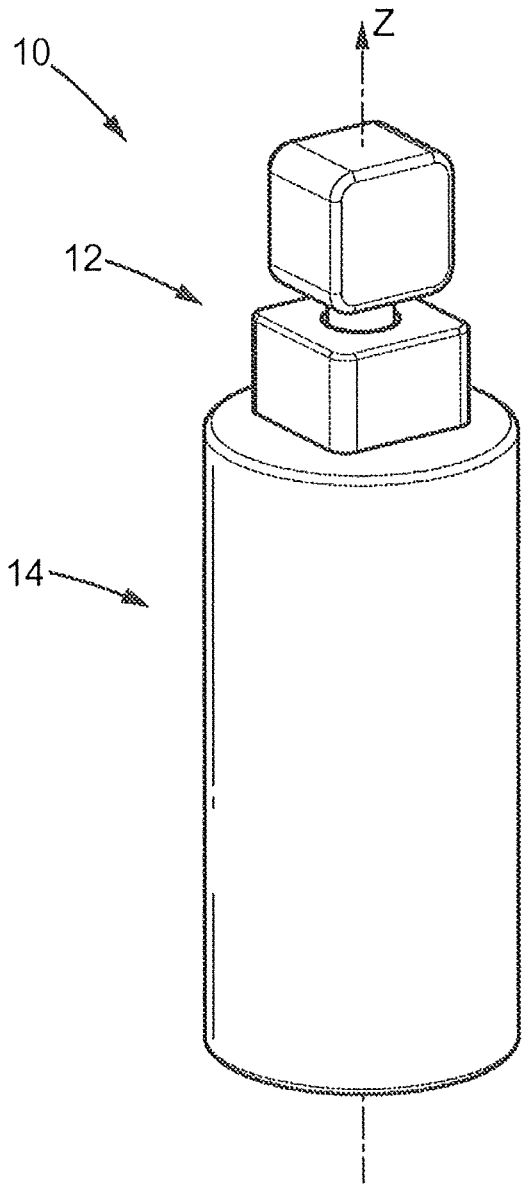
FIG. 1 is a perspective view of an assembly for packaging, refilling, and dispensing a fluid product according to a first embodiment of the invention.

FIG. 1 illustrates an assembly 10 for packaging, refilling, and dispensing a fluid product according to a first embodiment of the invention, with the fluid here being perfume.

Alternatively, the fluid can be any type of liquid, such as a cleaning product.

In another variant, the fluid product may be used in a field other than that of perfumery, such as cosmetics, pharmaceuticals, personal care, etc.

The assembly 10 comprises a refillable device 12 for packaging and dispensing perfume and a perfume refilling device 14.

In the following description, terms concerning orientation such as "vertical" and "horizontal" are used relative to the orientation of the assembly 10 when it is placed on a flat surface. Positional terms such as "upstream" and "downstream" are used relative to the direction of flow of fluid product in the part concerned.

Figure 2:
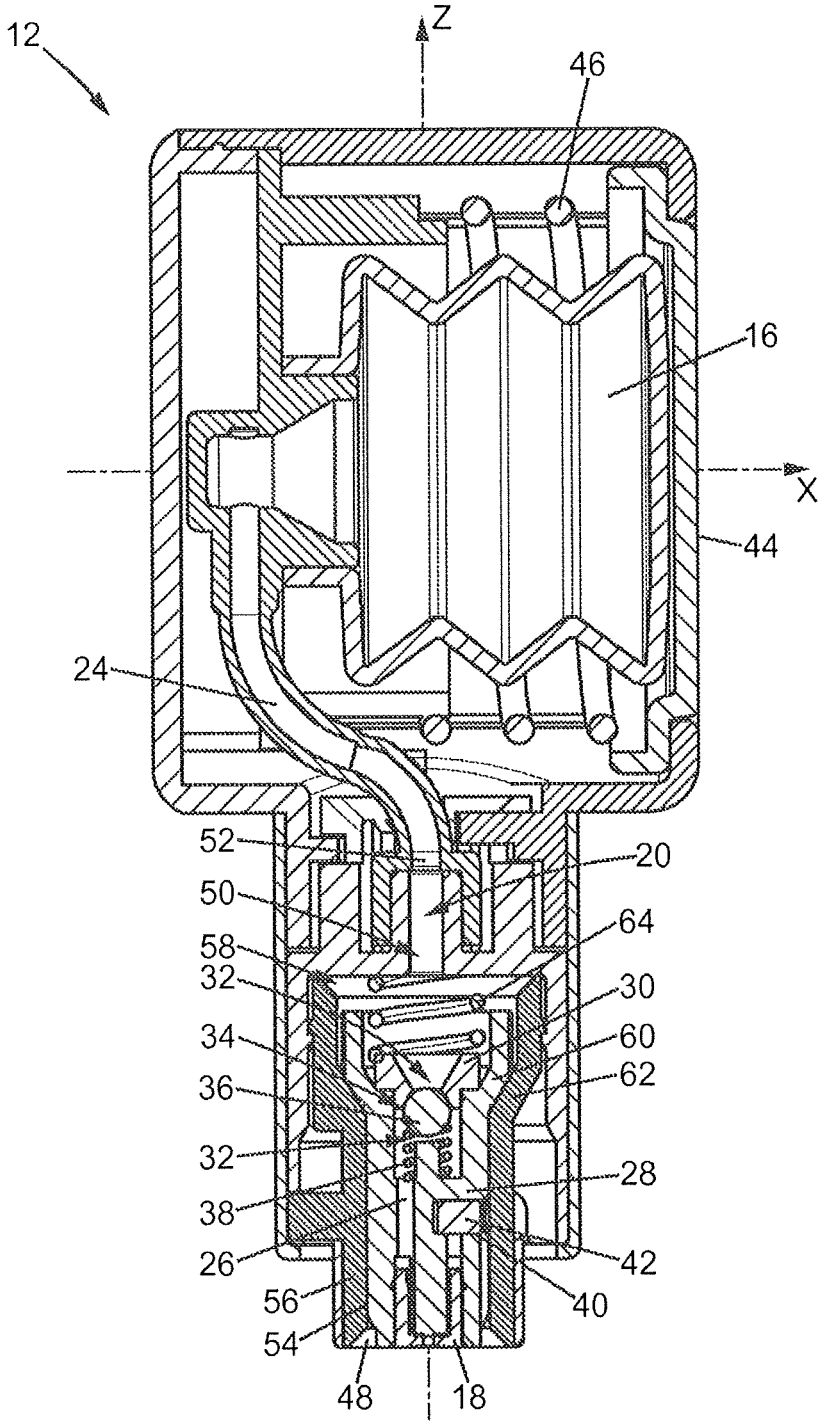
FIG. 2 is a longitudinal vertical sectional view of a refillable device of the assembly of FIG. 1.

Referring to FIG. 2, the refillable device 12 comprises a reservoir 16, a perfume dispensing nozzle 18, and a perfume dispensing passage 20 connecting the reservoir 16 and the nozzle 18.

The reservoir 16 defines a variable interior volume intended to contain the perfume.

The reservoir 16 is arranged to be able to receive a force exerted by a user in a manner that reduces its interior volume.

The reservoir 16 is elastically deformable and is resiliently biased towards a position of maximum volume.

This resilient biasing is specific to the material used for the reservoir 16 and/or to the shape of the reservoir 16 which gives the reservoir 16 an "elastic memory".

In the example, the reservoir 16 resembles a bellows which wants to return to its original shape, meaning its maximum interior volume, and is made of plastic.

Alternatively, the reservoir 16 may not be elastically deformable, and the biasing of the reservoir 16 toward the position of maximum volume is then obtained by biasing means. For example, the reservoir 16 may comprise a piston sliding within a cylinder and biased toward the position of maximum volume by a spring.

The reservoir 16 and the nozzle 18 are respectively arranged at opposite ends of the refillable device 12.

Here, the nozzle 18 is a perfume spray nozzle.

The dispensing passage 20 comprises an upstream section 24 leading to the reservoir 16 and a downstream section 26 leading to the nozzle 18.

The downstream section 26 is defined by an internal tube 28 which has the nozzle 18 at one of its ends, and by a funnel part 30 attached in the internal tube 28 opposite the nozzle 18.

The dispensing passage 20 is provided with a first closure system 32 adapted to be selectively opened/closed to allow/prevent the flow of perfume between the reservoir 16 and the nozzle 18.

The first closure system 32 comprises a valve 34 which is normally kept closed and which is adapted to open when the interior volume of the reservoir 16 decreases.

In the current example, the valve 34 is a ball valve having a ball 36 which is urged against the bottom of the funnel 30 by a resilient member 38, here a precompression spring.

The refillable device 12 further comprises an air inlet 40 formed in the internal tube 28 and leading to the dispensing passage 20 upstream of the nozzle 18.

The function of this air inlet is to create an air/perfume mixture that reduces the size of the perfume particles and therefore to provide a particularly fine spray.

The air inlet 40 is closed by a filter 42 permeable to air and impermeable to fluids, for example made of Gore-Tex® or Porex®, thereby further improving the quality of the spray provided by the nozzle 18.

The use of the air inlet 40 and/or the filter 42 is not limited to the present invention but may also be applied to any kind of liquid dispenser for which the dispensing is to be improved.

Alternatively, the quality of the spray provided by the nozzle 18 can be improved mechanically by the design of the nozzle 18 itself.

The refillable device 12 further comprises an actuation member 44 actuated by a user to act on the reservoir 16 in a manner that reduces its interior volume.

In the example concerned, the actuation member 44 is in the form of a cap and is mounted relative to the reservoir 16 so as to be movable between a dispensing position where the actuation member 44 presses against the reservoir 16, and a rest position where the actuation member 44 is not applying force to the reservoir 16.

In particular, the actuation member 44 is mounted so as to be linearly movable along a horizontal axis X.

The refillable device 12 comprises a resilient member 46, here a compression spring, which biases the actuation member 44 into the rest position.

Alternatively, the refillable device 12 may not comprise an actuation member 44, the user then acting directly on the reservoir 16 by exerting pressure on the reservoir 16 in a manner that reduces its interior volume.

The refillable device 12 also comprises a perfume filling opening 48 and a perfume filling channel 50 connecting the filling opening 48 and the reservoir 16.

The reservoir 16 and the filling opening 48 are respectively arranged at opposite ends of the refillable device 12.

In particular, the filling opening 48 and the nozzle 18 open onto one and the same face of the refillable device 12, the filling opening 48 and the nozzle 18 being concentric to each other and the filling opening 48 surrounding the nozzle 18.

The filling channel 50 comprises a downstream section 52 leading to the reservoir 16 and an upstream section 54 leading to the filling opening 48.

The downstream section 52 of the filling channel 50 and the upstream section 24 of the dispensing passage 20 coincide with each other.

The upstream section 54 of the filling channel 50 is defined by the internal tube 28 and an external tube 56 coaxial with the internal tube 28 and surrounding the internal tube 28.

The filling channel 50 is provided with a second closure system 58 adapted to be selectively opened/closed to allow/prevent a flow of perfume between the filling opening 48 and the reservoir 16.

The second closure system 58 is normally kept closed and is adapted to open by collaboration with the refilling device 14 when the refillable device 12 is mounted on the refilling device 14 as will be explained in more detail below.

In addition, the second closure system 58 is adapted to open by cooperation with the refilling device 14 only when the refillable device 12 is mounted on the refilling device 14.

"Only" is understood here to mean that the second closure system 58 does not open autonomously on its own.

The internal tube 28 is part of the second closure system 58 and is mounted so as to be linearly movable along a vertical axis Z relative to the external tube 56, between a normal usage position where the internal tube 28 obstructs the filling channel 50, and a filling position where the filling channel 50 is free of the internal tube 28.

More specifically, the internal tube 28 comprises a substantially conical central portion 60 and the external tube 56 comprises a substantially conical central portion 62 forming a seat for the central portion 60 of the internal tube 28.

Figure 4A:
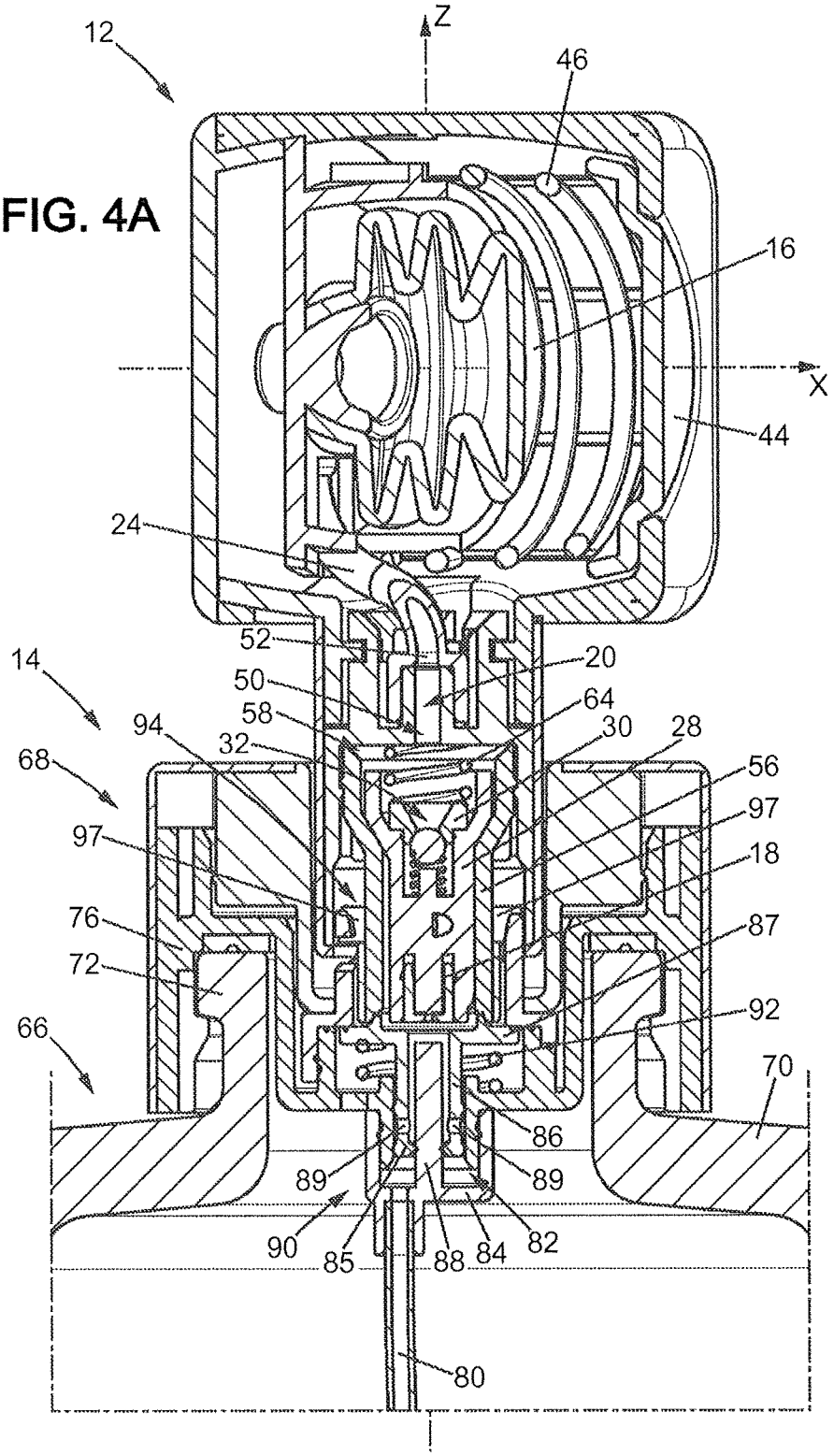
FIG. 4A is a longitudinal vertical sectional view of the assembly of FIG. 1 in an initial refilling position.
Figure 4B:
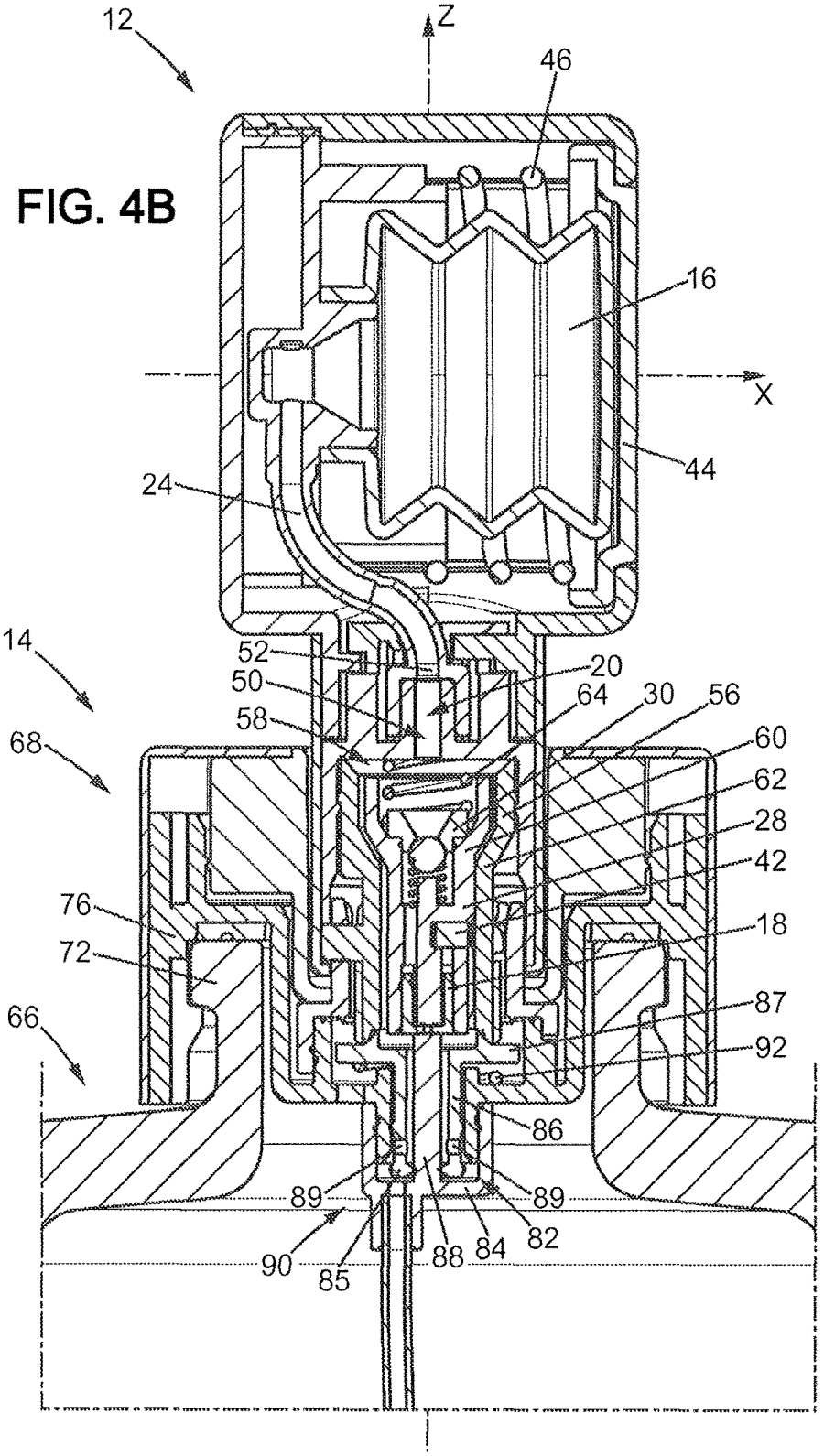
FIG. 4B is a view similar to that of FIG. 4A in a final refilling position.

In the usage position, the central portion 60 of the internal tube 28 rests on the central portion 62 of the external tube 56 (FIG. 2), while in the filling position, the central portion 60 of the internal tube 28 is at a distance from the central portion 62 of the external tube 56 (FIG. 4B).

The second closure system 58 further comprises an elastic member 64, for example a compression spring, biasing the internal tube 28 into the usage position.

To open the second closure system 58, or in other words to place it in its filling position, the central portion 60 of the internal tube 28 must be moved away from the central portion 62 of the external tube 56. This is performed by the refilling device 14 as will be explained below. Of course, it is technically possible to open the second closure system using a tool to move the internal tube away from the external tube, but this option is not part of the normal usage of an assembly such as those described here.

Figure 3:
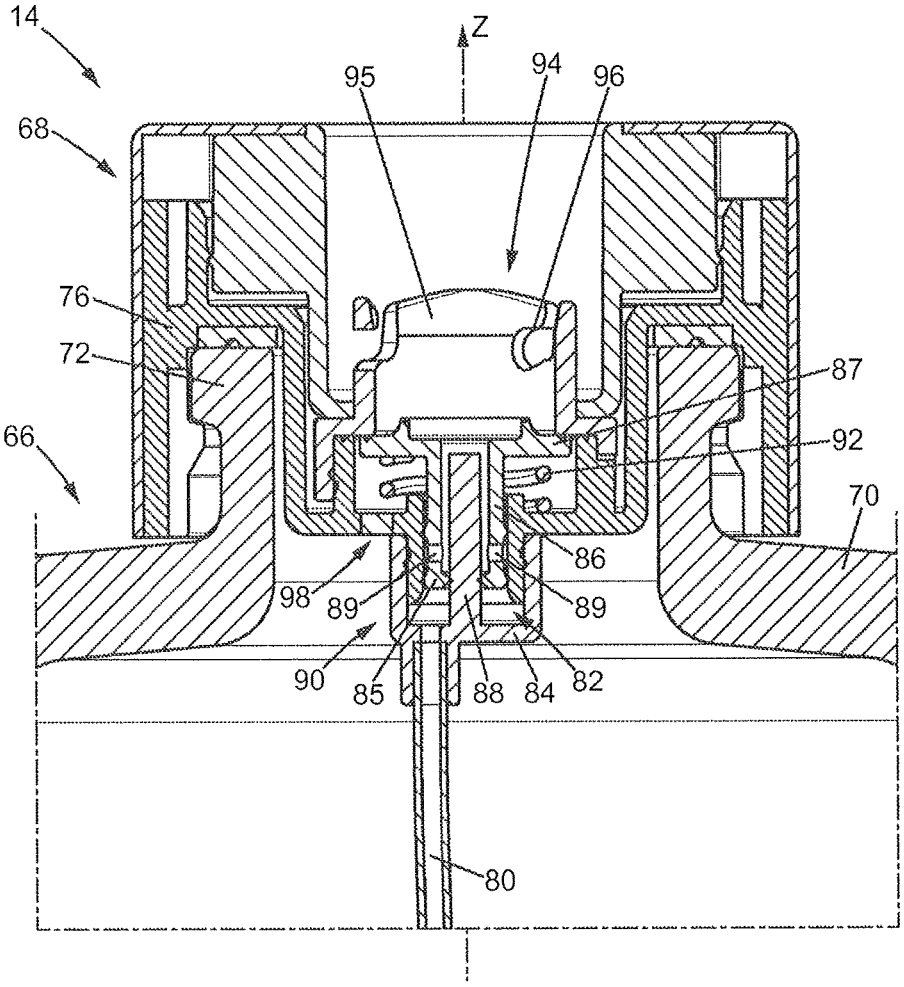
FIG. 3 is a longitudinal vertical sectional view of a refilling device of the assembly of FIG. 1.

Referring to FIG. 3, the refilling device 14 comprises a container 66 intended for holding perfume and a connector 68 mounted on the container 66.

The container 66 comprises a body 70 and a neck 72, the neck 72 extending as an extension of the body 70 and forming a shoulder relative to the body 70.

In the example described, the body 70 and the neck 72 have a substantially cylindrical shape with a vertical axis Z and a substantially circular cross-section.

The connector 68 comprises a support part 76 adapted for attachment to the neck 72, for example by clipping it on, in order to close the container 66 in a sealed manner.

Alternatively, the support 76 may be attached to the neck 72 by screwing, gluing, clamping, etc.

The connector 68 further comprises a dip tube 80 intended to extend into the perfume contained in the container 66 when the connector 68 is mounted on the container 66.

The connector 68 delimits a perfume filling duct 82 connected to the dip tube 80 and leading to the outside of the connector 68.

The filling duct 82 is defined by an upstream element 84 and a downstream element 86.

The upstream element 84 has a substantially tubular shape and comprises a center pin 88.

The upstream element 84 is attached to one end of the support part 76 and to the dip tube 80, with the dip tube 80 opening into the inside of the upstream element 84.

The downstream element 86 has a substantially tubular shape provided at one end with an end cap 85 and at the opposite end with a flange 87. At least one hole 89 is formed in the downstream element 86, adjacent to the end cap 85. In the example, two radially opposite holes 89 are formed in the downstream element 86, adjacent to the end cap 85.

The downstream element 86 is arranged partially inside the upstream element 84, substantially around the center pin 88.

The filling duct 82 is provided with a third closure system 90 adapted to be selectively opened/closed to allow/prevent a flow of perfume from the container 66, the third closure system 90 being adapted to open when the refillable device 12 is mounted on the refilling device 14.

In addition, the third closure system 90 is adapted to open only when the refillable device 12 is mounted on the refilling device 14.

Here, "only" is understood to mean that the third closure system 90 does not open autonomously on its own.

The downstream element 86 is part of the third closure system 90 and is mounted so as to be movable linearly along the vertical axis Z relative to the upstream element 84 in order to selectively open/close the filling duct 82 as will be explained in more detail below.

A resilient element 92, for example a compression spring, supported on the downstream element 86 and on the support part 76, biases the downstream element 86 into a position away from the upstream element 84.

To open the third closure system 90, the downstream element 86 must be moved away from the upstream element 84. This movement is performed by the refillable device 12 as will be explained in more detail below. Of course, it is technically possible to open the third closure system using a tool to move the downstream element away from the upstream element, but this option is not part of the normal usage of an assembly such as those described here.

The connector 68 further comprises locking means 94 adapted to lock the refillable device 12 into position on the refilling device 14.

In the current example, the locking means 94 comprise a bayonet system formed by a substantially tubular locking piece 95 attached onto the support part 76 in which there is at least one L-shaped groove 96 cooperating with a corresponding pin 97 projecting from the outer surface of the external tube 56 (FIG. 4A). In the current example, the locking means 94 comprise three sets of grooves 96/pins 97 angularly distributed at regular intervals about the vertical axis Z on the locking part 95/external tube 56.

Alternatively, the locking means 94 may comprise a ratchet system, for example two annular ribs respectively projecting from the inner surface of the locking piece 95 and from the outer surface of the external tube 56.

In another variant, the locking means 94 may comprise a magnet system, for example two complementary magnets respectively arranged on the inner surface of the locking piece 95 and on the outer surface of the external tube 56.

The refilling device 14 further comprises an escape (FIG. 3) for establishing equilibrium between the internal pressure of the container 66 and the atmospheric pressure.

In the example described here, the escape 98 comprises an air inlet and filter similar to the air inlet 40 and filter 42 of the refillable device 12.

Alternatively, the escape 98 may comprise a mechanism such as a valve that opens at the end of the stroke.

The operation of the assembly 10 is explained below.

The refillable device 12 is intended for use on its own, allowing it to be carried about by a user.

Initially, the refillable device 12 is filled with perfume (FIG. 2).

The reservoir 16 is in the position of maximum volume, its interior volume being filled with perfume, and the actuation member 44 is biased into the rest position by the spring 46.

The dispensing passage 20 is closed by the first closure system 32, the ball 36 of the valve 34 being biased against the bottom of the funnel 30 by the spring 38.

The filling channel 50 is also closed, by the second closure system 58, the internal tube 28 being biased into the usage position by the spring 64, the central portion 60 of the internal tube 28 thus being biased to press against the central portion 62 of the external tube 56.

Perfume also fills the common section of the dispensing passage 20 and filling channel 50, meaning the upstream section 24 of the dispensing passage 20 and the downstream section 52 of the filling channel 50.

Perfume also fills a portion of the downstream section 26 of the dispensing passage 20, namely an upstream portion of the internal tube 28 and the funnel 30.

The portion of the filling channel 50 located downstream of the contact between the internal tube 28 and the external tube 56 also contains perfume.

When the user wishes to apply perfume 22, she presses on the actuation member 44 against the action of the spring 46.

The actuation member 44 is then in the dispensing position where it is pressing against the reservoir 16.

Due to the force exerted by the user via the actuation member 44, the reservoir 46 is compressed and folded against itself, decreasing its interior volume.

The decrease in interior volume of the reservoir 16 increases the pressure in the dispensing passage 20, which overcomes the action of the spring 38 to move the ball 36 away from the funnel 30.

The first closure system 32 is then open, which allows perfume to flow to the nozzle 18 while being accelerated by the shape of the funnel 30, which further increases the pressure in the dispensing passage 20 and allows the nozzle 18 to spray the perfume in a mist of good quality.

The quality of the released spray of perfume is also ensured by the spring 38, which is sized/calibrated to ensure a minimum perfume release pressure.

The decrease in interior volume of the reservoir 16 also results in increased pressure in the filling channel 50, which applies additional closing force on the internal tube 28, thus ensuring closure of the second closure system 58 while the perfume is being sprayed through the nozzle 18.

When the user stops pressing on the actuation member 44, the spring 46 relaxes and the actuation member 44 returns to its rest position.

Because the pressure increase in the dispensing passage 20 has stopped, the spring 38 relaxes and the ball 36 is pressed against the bottom of the funnel 30.

The first closure system 32 is thus closed once more, preventing perfume from flowing to the nozzle 18, and the second closure system 58 remains closed.

As the refillable device 12 is a device without air intake ("airless") and is fluidtight, the reservoir 16 remains compressed.

At this stage, either the refillable device 12 no longer contains any perfume and it is then possible to refill it with perfume using the refilling device 14 as will be explained below, or there is still perfume in the refillable device 12.

If there is still perfume in the refillable device 12 and the user wishes to reapply perfume, she repeats the steps described above as many times as desired and as long as the refillable device 12 contains perfume.

Once the refillable device 12 is empty, the user then has the possibility of refilling it with perfume using the refilling device 14.

Referring to FIG. 3, the container 66 contains perfume and is closed off by the connector 68, with the support part 76 attached to the neck 72 and the dip tube 80 extending into the perfume.

The downstream element 86 of the connector 68 is urged by the spring 92 into the position away from the upstream element 84, closing the third closure system 90.

In this away position, the end cap 85 of the downstream element 86 closes off the filling duct 82, thus preventing perfume from flowing from the container 66 to outside the connector 68.

The user places the refillable device 12 on the refilling device 14 by inserting the external tube 56 into the connector 68 until the external tube 56 comes into contact with the flange 87 of the downstream element 86 (FIG. 4A).

In this initial refilling position, the filling channel 50 and the filling duct 82 are in fluid communication with each other.

Continuing the insertion movement along the vertical axis Z results in the external tube 56 pressing on the downstream element 86, against the action of the spring 92, thus moving the downstream element 86 toward the upstream element 84 and thereby freeing the filling duct 82 of its end cap 85, until the center pin 88 of the upstream element 84 comes into contact with the nozzle 18.

By further continuing the insertion movement, the external tube 56 continues to press on the downstream element 86 while the internal tube 28, blocked by the central pin 88, retracts relative to the external tube 56 against the action of the spring 64.

The filling duct 50 is then free of the internal tube 28 which is now in the filling position.

The refillable device 12 is then turned about the vertical axis Z to lock it into position on the refilling device 14, the pins 97 of the bayonet system cooperating with the corresponding grooves 96 (FIG. 4B). It is for this reason that the refillable device 12 is not shown in the same sectional plane in FIGS. 4A and 4B, unlike the refilling device 14.

When the filling channel 50 is opened, the reservoir 16 is urged toward the position of maximum volume, creating a lower pressure in the filling channel 50 which results in suctioning the perfume contained in the container 66 of the refilling device 14 and filling the refillable device 12.

Once the refillable device 12 is filled with perfume, the user simply needs to disconnect it from the connector 68 by disengaging the pins 97 from the grooves 96, and to move it away from the refilling device 14.

This causes the second closure system 58 and then the third closure system 90 to close.

The refillable device 12 can then once again be used on its own and carried about by the user.

In this first embodiment, the refillable device 12 and the connector 68 are adapted to open the second and third closure systems 58, 90 automatically when the refillable device 12 is mounted on the refilling device 14.

In other words, the second and third closure systems 58, 90 are opened simply by mounting the refillable device 12 on the refilling device 14, without requiring any further action by the user, the refillable device 12 also being refilled with perfume automatically.

"Automatic" therefore is understood to mean "requiring only one action by the user."

Figure 5:
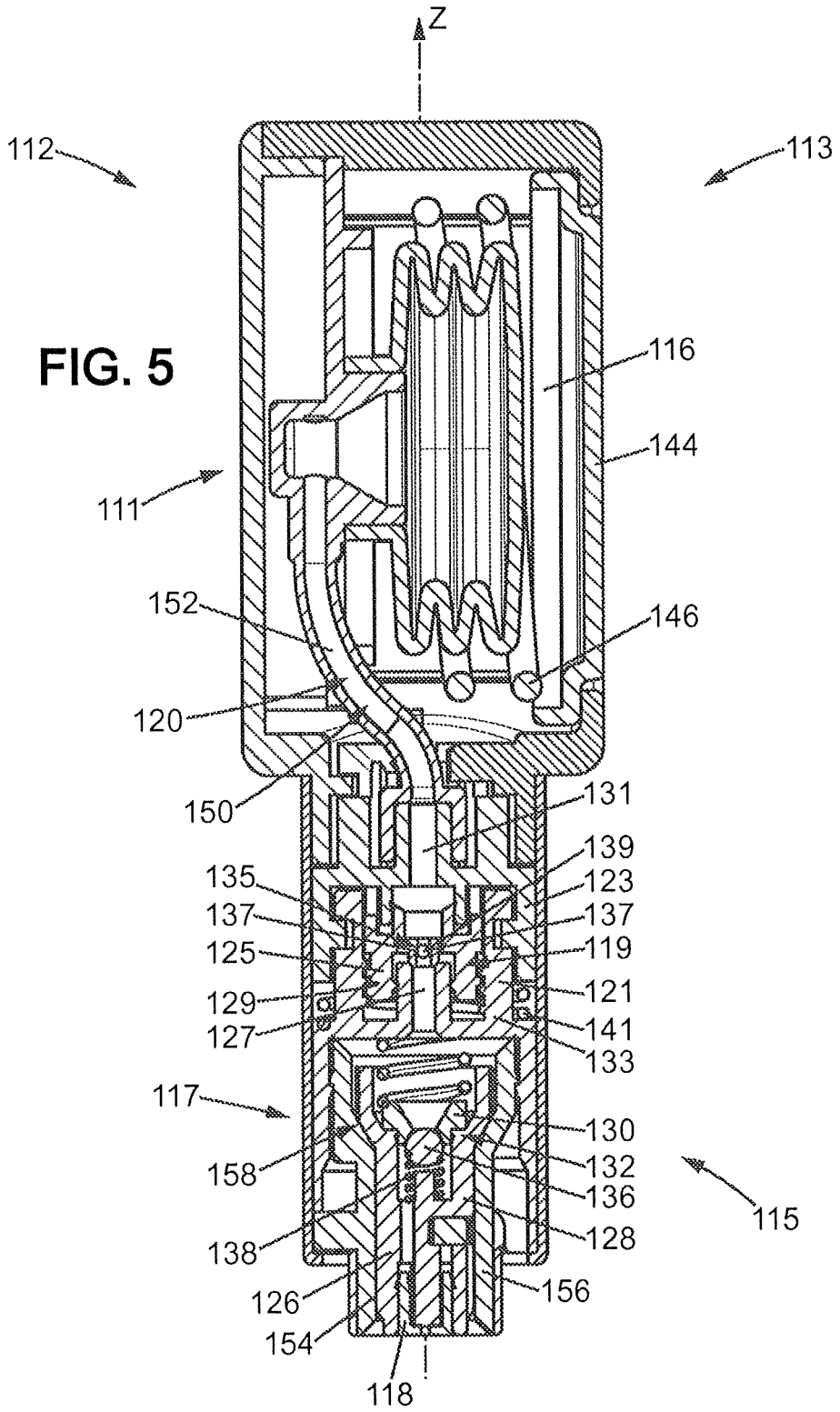
FIG. 5 is a longitudinal vertical sectional view of a refillable device of an assembly for packaging, refilling, and dispensing a fluid product according to a second embodiment of the invention.

FIG. 5 illustrates the refillable device 112 of an assembly 110 for packaging, refilling, and dispensing perfume according to a second embodiment of the invention.

This second embodiment of the invention, which is similar to the first embodiment, will not be described again here in all its details. It is similar to the first embodiment of FIGS. 1 to 4B in that the second and third closure systems 158, 190 are opened automatically, but it differs in that an additional action beyond simply mounting the refillable device 112 on the refilling device 114 must be performed by the user in order to fill the refillable device 112.

Refilling device 114 is identical to refilling device 14 of the first embodiment.

Refillable device 112 comprises an upper casing 111 which houses the reservoir 116, actuation member 144, spring 146, and common section of dispensing passage 120 and filling channel 150, all these elements forming an upper portion 113 of refillable device 112.

A lower portion 115 of refillable device 112 is formed by a lower casing 117 which houses the internal tube 128, external tube 156, first closure system 132, second closure system 158, downstream section 126 of dispensing passage 120, and upstream section 154 of filling channel 150.

Upper portion 113 is mounted so as to rotate relative to lower portion 115 about the vertical axis Z.

Refillable device 112 comprises a fourth closure system 119 adapted to be selectively opened/closed to allow/prevent the flow of perfume through filling channel 150.

In particular, fourth closure system 119 is normally in a closed position and is adapted to open when second and third closure systems 158, 190 are open.

In addition, fourth closure system 119 is adapted to open only when second and third closure systems 158, 190 are open.

Fourth closure system 119 is housed within the lower portion 115 and comprises a fixed part 121, a cam part 123, and a follower part 125.

Fixed part 121 is attached to external tube 156 and delimits an intermediate section 127 of filling channel 150 between upstream and downstream sections 152, 154.

Fixed part 121 comprises an internal thread 129.

Cam part 123 is attached to the upper casing 111 and also delimits an intermediate section 131 of filling channel 150 between upstream and downstream sections 152, 154.

Cam part 123 is mounted so as to rotate about the vertical axis Z relative to fixed part 121.

Follower part 125 is arranged between fixed part 121 and cam part 123 and comprises an external thread 133 which cooperates with the internal thread 129 of fixed part 121.

Follower part 125 further comprises a blocking means 135 arranged in the filling duct 150, in the current example formed by a ball 137 cooperating with a seating 139 of follower part 125.

Follower part 125 is prevented from rotation about the vertical axis Z and is linearly movable along said axis relative to cam part 123, and is therefore movable relative to fixed part 121 in a helical movement.

An elastic member 141, for example a tension spring, is interposed between fixed part 121 and cam part 123 so as to bias the fourth closure system 119 into the closed position.

The operation of assembly 110 is explained below.

To fill refillable device 112, the device is locked into position on refilling device 114 in the same manner as in the first embodiment.

First closure system 132 is closed while second and third closure systems 158, 190 are open.

Fourth closure system 119 is biased into the closed position by spring 141, the blocking device 135 of follower part 125 closing off filling channel 150 due to the lower pressure inside refillable device 112 which presses ball 137 against seating 139.

To fill refillable device 112 with perfume, the user rotates the upper portion 113 about the vertical axis Z.

This rotation causes rotation of cam part 123, which then causes helical movement of follower part 125 along the vertical axis Z, thereby freeing filling channel 150.

While filling channel 150 is open, reservoir 116 is urged toward the position of maximum volume, which causes the perfume contained in container 166 of refilling device 114 to be drawn into and fill refillable device 112.

Once refillable device 112 is filled with perfume, the user simply needs to release the upper portion 113 in the same manner as in the first embodiment, which automatically closes fourth closure system 119 due to the action of spring 141.

The user then detaches refillable device 112 from connector 168, causing the second and third closure systems 158, 190 to close, and removes it from refilling device 114.

Refillable device 112 can now once again be used on its own and carried about by the user.

To spray the perfume, the user presses on actuation member 144. The decrease in interior volume of reservoir 116 causes a pressure increase in dispensing passage 120 which moves ball 137 away from its seating 139 and ball 136 away from funnel 130 against the action of spring 138.

The first and fourth closure systems 132, 119 are thus opened and allow perfume to flow to nozzle 118, which sprays the perfume as a mist.

Alternatively, the additional action to be performed by the user in order to fill refillable device 112 may be different from a rotation of the upper portion 113, and may consist for example of pressing a push button positioned on refillable device 112 or on refilling device 114.

Figure 6:
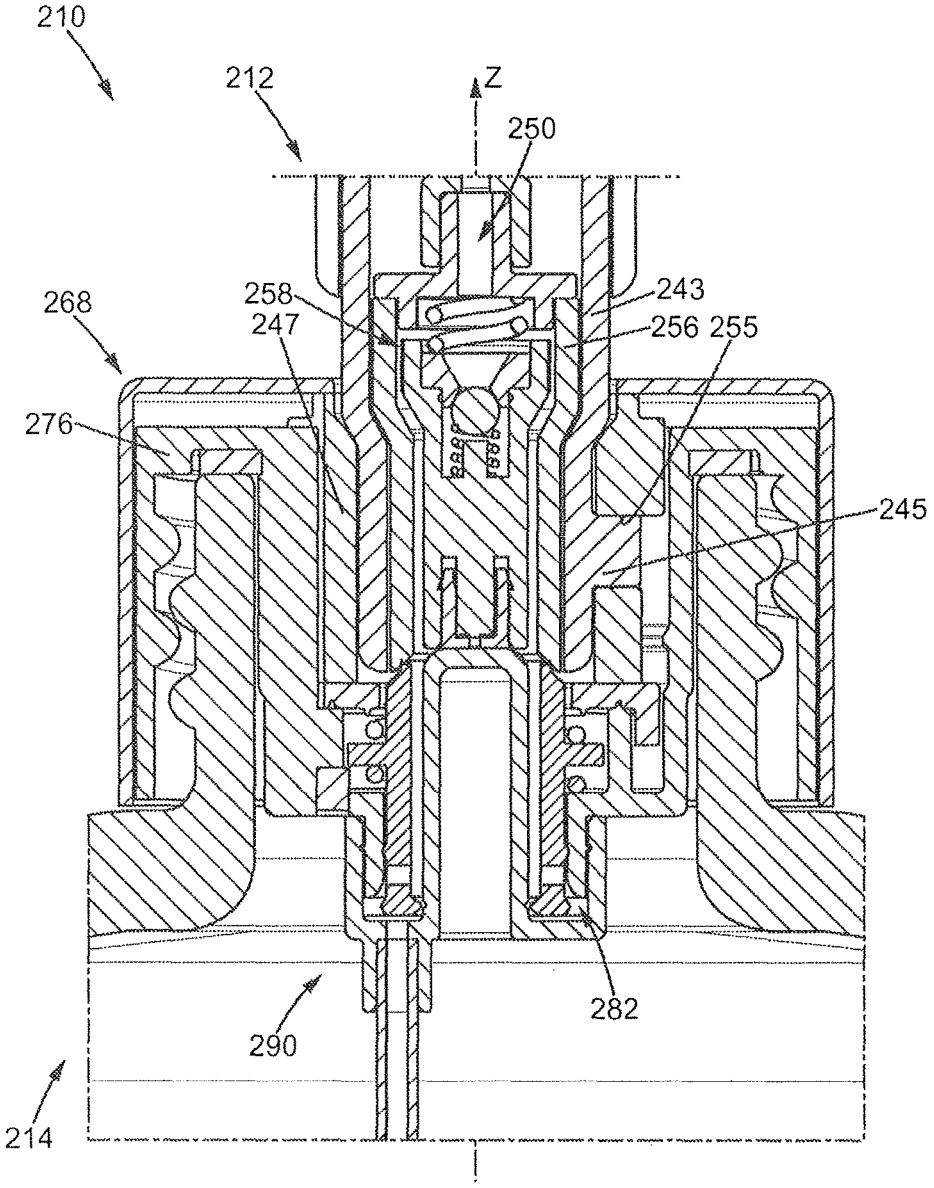
FIG. 6 is a longitudinal vertical sectional view of a portion of an assembly for packaging, refilling, and dispensing a fluid product according to a third embodiment of the invention, in a final refilling position.
Figure 7:
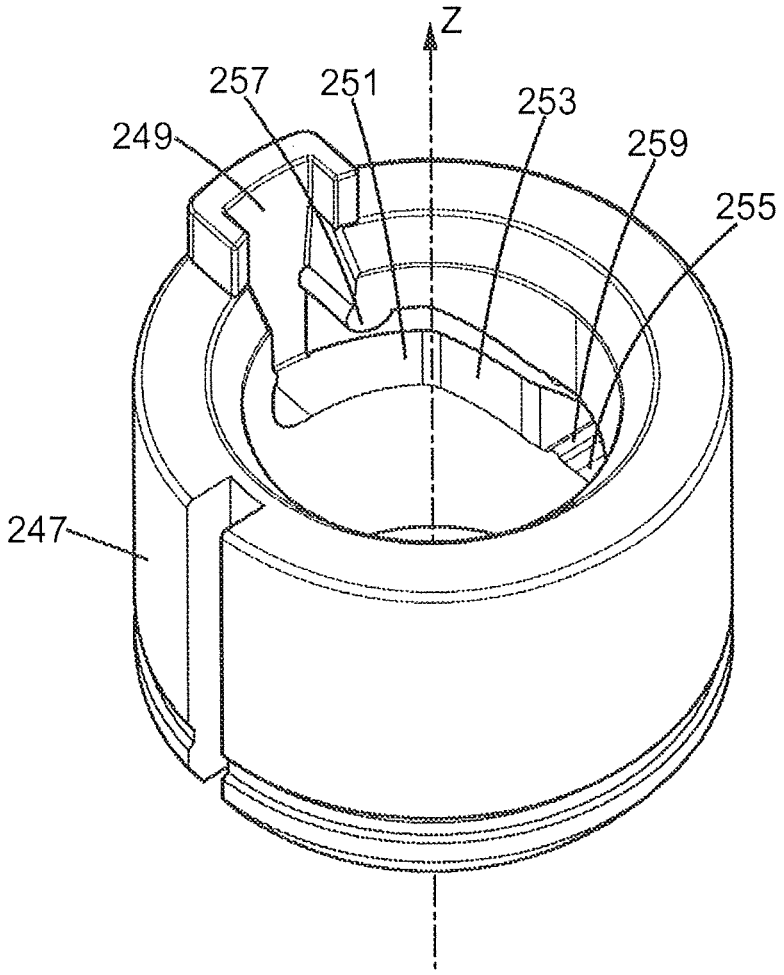
FIG. 7 is a perspective view of a portion of the assembly of FIG. 6.
Figure 8:
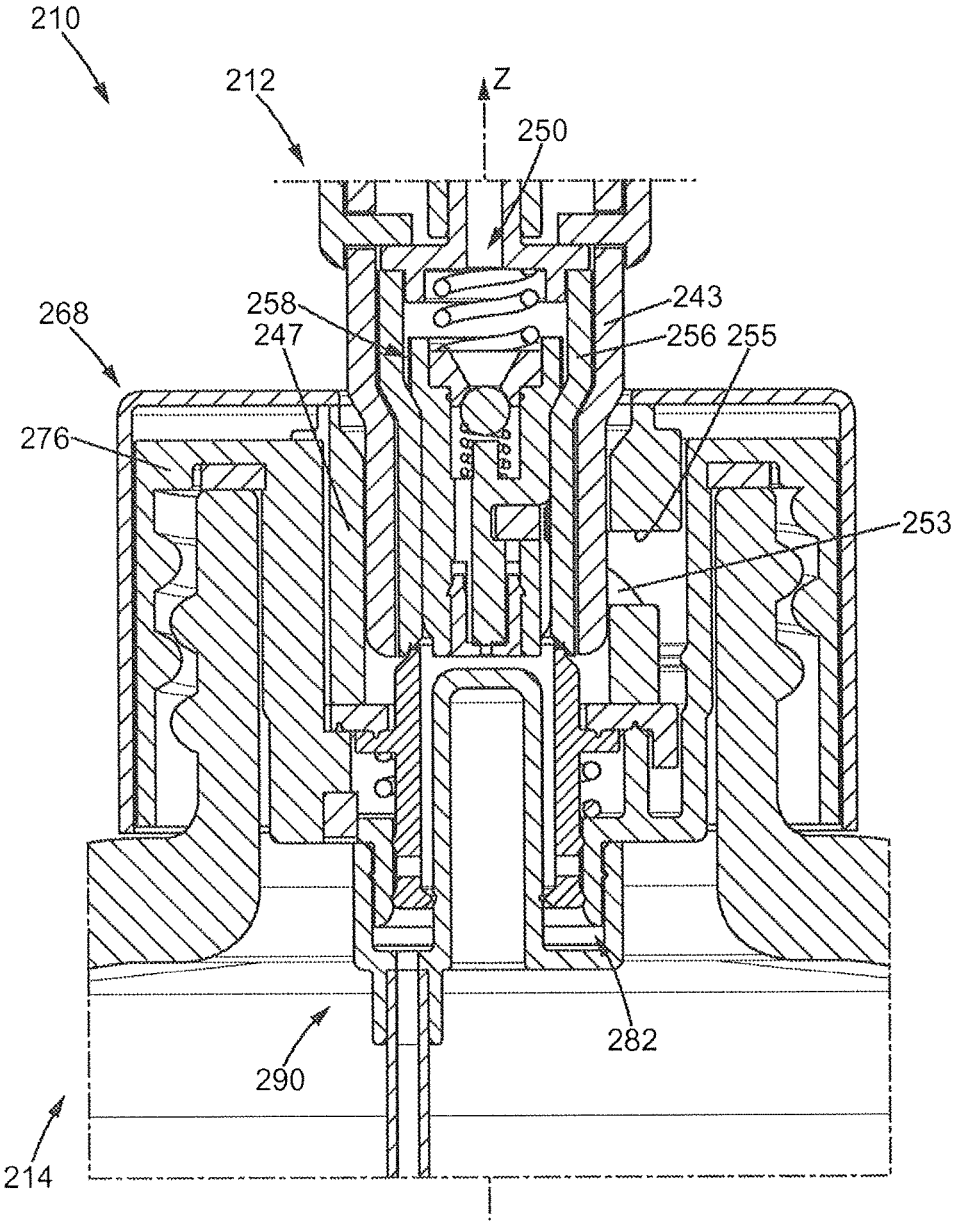
FIG. 8 is a view similar to that of FIG. 6 but in an intermediate packaging position.

FIGS. 6, 7 and 8 illustrate an assembly 210 for packaging, refilling, and dispensing perfume according to a third embodiment of the invention.

This third embodiment of the invention, which is similar to the first and second embodiments, will not be described again here in all its details. It differs from the first and second embodiments of FIGS. 1 to 5 in that an intermediate packaging position of the assembly 210 is provided which is such that neither the opening of the second and third closure systems 258, 290 nor the filling of the refillable device 212 are performed automatically. In other words, an additional action, other than simply mounting refillable device 212 on refilling device 214, must be taken by the user in order to open second and third closure systems 258, 290 and to fill refillable device 212.

Refillable device 212 is substantially identical to refillable device 12 of the first embodiment and further comprises a support tube 243 surrounding the external tube 256 and a stud 245 (FIG. 6) projecting radially outward from support tube 243.

Refilling device 214 is substantially identical to refilling device 14 of the first embodiment, and connector 268 further comprises an intermediate part 247 attached to the inside of support part 276.

Referring to FIG. 7, intermediate part 247 is substantially tubular and comprises a first vertical groove 249 extended by a second horizontal groove 251, which itself is extended by a third spiraling groove 253, which itself is extended by a fourth horizontal groove 255.

The first, second, third, and fourth grooves 249, 251, 253, 255 are adapted to receive the stud 245.

Intermediate part 247 comprises a first latching bead 257 substantially at the junction of first vertical groove 249 and second horizontal groove 251, and a second latching bead 259 substantially at the junction of third spiraling groove 253 and fourth horizontal groove 255.

The operation of assembly 210 is explained below.

To fill refillable device 212, said device is placed on refilling device 214 by inserting stud 245 into first vertical groove 249 until it meets first bead 257.

The user then forces refillable device 212 onto refilling device 214 so that stud 245 moves beyond first bead 257 and reaches second horizontal groove 251.

In this packaging or intermediate position of assembly 210 (FIG. 8), refillable device 212 is clipped onto refilling device 214 but the second and third closure systems 258, 290 are still closed.

This intermediate position allows ensuring a better seal of both refillable device 212 and refilling device 214, preventing the evaporation of the perfume located inside the two devices which can occur if both devices remain separated for too long.

In addition, the intermediate position also allows leaving the two devices unused for a period of time, with refillable device 212 being empty. The advantage is that it is better to store perfume in a large amount within refilling device 214, rather than in a small amount within refillable device 212, especially when the material of the reservoir 216 is less resistant to corrosion than the material of the container 266 which is generally made of glass.

When the user wishes to recharge refillable device 212, she rotates it about the vertical axis Z relative to refilling device 214.

The stud 245 then follows the third spiraling groove 253, causing vertical/axial movement of refillable device 212 along the vertical axis Z and thus freeing filling channel 250 and filling duct 282, the opening of second and third closure systems 258, 290 being identical to that of the first embodiment.

By continuing the rotary movement of refillable device 212, stud 245 slides into place in fourth horizontal groove 255 beyond the second bead 259, thereby locking refillable device 212 into position on refilling device 214.

The invention thus provides a refillable device that is simple to use and manufacture while being compact and fluidtight.

The refillable device of the invention is also compact, therefore easily carried about, and there is limited risk of leakage of the fluid product and of obstruction of the nozzle and filling opening by foreign bodies such as dust.

As mentioned above, the refillable device operates without air intake ("airless").

This airless operation is implemented, during use of the refillable device, by means of the check valve of the first closure system which prevents outside air from entering the reservoir, by means of the second closure system which remains closed during use of the refillable device and thus also prevents outside air from entering the reservoir, and by means of the fluidtight reservoir which thus remains compressed after force is exerted by the user. It should be noted that in order to hide any unsightly appearance of the refillable device when the reservoir is in the compressed state, the actuation member is biased into its rest position.

In addition, when filling the refillable device, it is precisely this airless operation which allows drawing product contained in the refilling device toward the reservoir. When the refillable device is mounted on the refilling device and the filling channel is open, the reservoir, which has been compressed to this point, returns to its position of maximum volume which creates a lower pressure in the filling channel and suctions the product.

Thus, unlike the dispensing systems with air intake, in which the amount of product expelled is replaced by an equal amount of outside air, the airless device according to the invention protects the product from possible contamination by the outside environment, for example by bacteria and microorganisms. The product is never in contact with the air until it is dispensed, which has the advantage of limiting any changes in the product, its purity and effectiveness remaining substantially intact. The airless character of the refillable device also contributes to reducing obstruction of the filling opening by foreign bodies.

The invention claimed is:

1. A refillable device for packaging and dispensing a fluid product, comprising:

a reservoir delimiting a variable interior volume for containing said fluid product;

a fluid product dispensing nozzle;

a fluid product dispensing passage connecting the reservoir and the nozzle and provided with a first closure system adapted to be selectively;

opened to allow a flow of fluid product between the reservoir and the nozzle, or closed to prevent a flow of fluid product between the reservoir and the nozzle;

a fluid product filling opening; and a fluid product filling channel connecting the filling opening and the reservoir and provided with a second closure system adapted to be selectively;

opened to allow a flow of fluid product between the filling opening and the reservoir, or closed to prevent a flow of fluid product between the filling opening and the reservoir, the second closure system being normally kept closed and adapted to open by cooperation with a fluid product refilling device when the refillable device is mounted on said refilling device, wherein the reservoir is arranged to be able to receive a force exerted by a user in a manner that reduces its interior volume, the nozzle and the filling opening open onto one and the same face of the refillable device, and the refillable device is a device without air intake into the reservoir.

2. The refillable device according to claim 1, wherein the first closure system comprises a valve which is normally kept closed and which is adapted to open when the interior volume of the reservoir decreases.

3. The refillable device according to claim 1, wherein the nozzle and the filling opening are concentric to each other.

4. The refillable device according to claim 1, wherein the reservoir is resiliently biased toward a position of maximum volume.

5. The refillable device according to claim 1, further comprising an air inlet which opens into the dispensing passage upstream of the nozzle and downstream of said first closure system, the air inlet being closed off by a filter permeable to air and impermeable to fluids.

6. An assembly for packaging, refining, and dispensing a fluid product, wherein the assembly comprises:

the refillable device according to claim 1; and a fluid product refilling device, comprising:

a container intended for containing said fluid product; and a connector mounted on the container and defining a filling duct for fluid product, provided with a third closure system adapted to be selectively opened/closed to allow/prevent a flow of fluid product from the container, the refillable device being adapted for mounting on the connector of the refilling device so that the filling channel and the filling duct are in fluid communication with each other, the second and third closure systems being adapted to be open when the refillable device is mounted on the refilling device.

7. The assembly according to claim 6, wherein the third closure system comprises an obturator arranged in the filling duct and mounted so as to be movable relative to the filling duct in order to selectively close/open the filling duct.

8. The assembly according to claim 7, wherein the third closure system further comprises a resilient member adapted to bias the obturator into a position where the obturator closes the filling duct.

9. The assembly according to claim 6, wherein the refillable device and the connector are adapted to open the second and third closure systems automatically when the refillable device is mounted on the refilling device.

10. The assembly according to claim 6, wherein the refillable device comprises a fourth closure system adapted to be selectively opened/closed to allow/prevent a flow of fluid product through the filling channel.

11. The assembly according to claim 10, wherein the fourth closure system is normally in a closed position and is adapted to open when the second and third closure systems are open.

12. A refillable device for packaging and dispensing a fluid product, comprising:

a reservoir delimiting a variable interior volume for containing said fluid product;

a fluid product dispensing nozzle;

a fluid product dispensing passage connecting the reservoir and the nozzle and provided with a first closure system adapted to be selectively opened to allow a flow of fluid product between the reservoir and the nozzle or closed to prevent a flow of fluid product between the reservoir and the nozzle;

a fluid product filling opening; and a fluid product filling channel connecting the filling opening and the reservoir and provided with a second closure system adapted to be selectively;

opened to allow a flow of fluid product between the filling opening and the reservoir, or closed to prevent a flow of fluid product between the filling opening and the reservoir, the second closure system being normally kept closed and adapted to open by cooperation with a fluid product refilling device when the refillable device is mounted on said refilling device, wherein the reservoir is arranged to be able to receive a force exerted by a user in a manner that reduces its interior volume, the nozzle and the filling opening open onto one and the same face of the refillable device, and the refillable device is a device without air intake into the reservoir, wherein the nozzle and the filling opening are concentric to each other, and wherein the dispensing passage comprises a downstream section leading to the nozzle, said downstream section being defined by an internal tube which supports the nozzle, and the filling channel comprises an upstream section leading to the filling opening and defined by the internal tube and an external tube coaxial with the internal tube.

13. The refillable device according to claim 12, wherein the internal tube is part of the second closure system and is mounted so as to be movable relative to the external tube between a normal usage position where the internal tube obstructs the filling channel, and a filling position where the filling channel is free of the internal tube, the second closure system further comprising a resilient member urging the internal tube into the usage position.

14. A refillable device for packaging and dispensing a fluid product, comprising:

a reservoir delimiting a variable interior volume for containing said fluid product;

a fluid product dispensing nozzle;

a fluid product dispensing passage connecting the reservoir and the nozzle and provided with a first closure system adapted to be selectively opened to allow a flow of fluid product between the reservoir and the nozzle or closed to prevent a flow of fluid product between the reservoir and the nozzle;

a fluid product filling opening; and a fluid product filling channel connecting the filling opening and the reservoir and provided with a second closure system adapted to be selectively;

opened to allow a flow of fluid product between the filling opening and the reservoir, or closed to prevent a flow of fluid product between the filling opening and the reservoir, the second closure system being normally kept closed and adapted to open by cooperation with a fluid product refilling device when the refillable device is mounted on said refilling device, wherein the reservoir is arranged to be able to receive a force exerted by a user in a manner that reduces its interior volume, the nozzle and the filling opening open onto one and the same face of the refillable device, and the refillable device is a device without air intake into the reservoir the refillable device further comprising an actuation member actuated by a user to act on the reservoir.

15. The refillable device according to claim 14, wherein the actuation member is mounted so as to be movable relative to the reservoir between a dispensing position where the actuation member presses against the reservoir, and a rest position where the reservoir is not biased by the actuation member.

* * * * *